US006695419B2

(12) United States Patent
Searer et al.

(10) Patent No.: US 6,695,419 B2
(45) Date of Patent: Feb. 24, 2004

(54) DRAWERS WITH ADJUSTABLE DRAWER DIVIDERS

(76) Inventors: Floyd A. Searer, 3630 Gordon Rd., Elkhart, IN (US) 46516; Charles Tack, 2648 E CR 100N, Warsaw, IN (US) 46582

( * ) Notice: Subject to any disclaimer, the term of this patent is extended or adjusted under 35 U.S.C. 154(b) by 0 days.

(21) Appl. No.: 09/954,208

(22) Filed: Sep. 18, 2001

(65) Prior Publication Data

US 2003/0052582 A1 Mar. 20, 2003

(51) Int. Cl.[7] ..... A47B 88/00
(52) U.S. Cl. ..... 312/348.3; 220/529; 206/561
(58) Field of Search ..... 312/205, 291, 312/348.3, 348.5; 220/528, 529, 23.83, 23.86; 206/561; 11/0.84

(56) References Cited

U.S. PATENT DOCUMENTS

| | | | | | |
|---|---|---|---|---|---|
| 1,341,695 | A | * | 6/1920 | White et al. | 206/561 X |
| 1,857,305 | A | * | 5/1932 | Holliday | 206/561 |
| 2,286,785 | A | * | 6/1942 | Carlson | 206/561 |
| 3,581,929 | A | * | 6/1971 | Guenard et al. | 220/529 |
| 4,071,286 | A | * | 1/1978 | Moyer | 312/348.3 |
| 4,443,046 | A | * | 4/1984 | Hannah | 312/183 |
| 5,058,765 | A | * | 10/1991 | Gomi et al. | 220/528 |
| 5,992,959 | A | * | 11/1999 | Kawamoto | 312/348.3 |
| 6,073,794 | A | * | 6/2000 | Bidot | 312/348.3 |

FOREIGN PATENT DOCUMENTS

| | | | | |
|---|---|---|---|---|
| DE | 3901331 | * | 7/1990 | 312/348.3 |
| GB | 2134884 | * | 8/1984 | 220/533 |
| GB | 2167389 | * | 5/1986 | 220/528 |

* cited by examiner

*Primary Examiner*—Lanna Mai
*Assistant Examiner*—Hanh V. Tran

(57) ABSTRACT

The drawer structure enables drawer space to be conveniently divided, and includes L-shaped dividers cut to a desired length and placed within the drawer, and formed in any combination of width and length to fill the drawer bottom and providing individual compartments within it. Additional division of the drawer space is provided by transversely extending dividers that are mounted to the upstanding legs of desired ones of the L-shaped dividers. These transversely extending dividers may include a number of snap-off portions to accommodate the width of the space being transversely further divided.

8 Claims, 7 Drawing Sheets

DRAWERS WITH ADJUSTABLE DRAWER DIVIDERS

BACKGROUND OF THE INVENTION

1. Field of the Invention

This invention relates to drawers and drawer dividers for dividing drawer space, and more particularly to drawers furnished with L-shaped dividers cut to a desired length and placed within the drawer, and formed in any combination of width and length to fill the drawer bottom and providing individual compartments within it. Transversely mounted dividers may be mounted in a clip-on fashion to the upstanding L-shaped legs of the dividers to provide further division of the drawer space in selected ones of the previously formed spaces.

2. Related Art

The common U-shaped channel design having redundant vertical dividers that are back-to-back and face-to-face when placed in the drawer.

SUMMARY OF THE INVENTION

This drawer and adjustable drawer divider structure of the invention enables drawer space to be conveniently divided, and includes L-shaped dividers out to a desired length and placed within the drawer, and formed in any combination of width and length to fill the drawer bottom and providing individual compartments within it. The legs of the L-shaped dividers can be of various widths in either one or both directions to accommodate the depth of the drawer and the desired height of each compartment, with the length of the divider remaining the same. The legs resting on the bottom of the drawer may be cut to a custom size or an inert added to increase the area between the dividing walls of the lineal divider. Additional division of the drawer space is provided by transversely extending dividers that are mounted to the upstanding legs of desired ones of the L-shaped dividers. These transversely extending divers may include a number of snap-off portions to accommodate the width of the space being transversely further divided.

The invention provides virtually unlimited variable compartment sizes and shapes while utilizing drawer space more efficiently than other drawer divider structure such as the common U-shaped channel design, which has a redundant vertical legs that are back-to-back and face-to-face when placed in the drawer.

It is a primary feature of the invention that a number of variable compartment shapes and sizes may be provided in a drawer by altering the width of the legs of the L-shaped divider and the use of clip-on dividers mounted transverse to the upper leg portions of the L-shaped dividers.

It is a primary advantage of the invention that mere alteration of the width of either one or both legs of the L-shaped dividers and the additional transversely extending dividers enables a desired variation in the size and shape of the various compartments of the drawer.

Another advantage of the invention is that the L-shaped dividers may be made of any material usually used in the manufacture of drawers, such as wood, composite wood, plastic, metal, etc.

BRIEF DESCRIPTION OF THE DRAWINGS

The above objects, features and advantages of the invention are believed to be readily apparent from the following description of a preferred embodiment of the best mode of carrying out the invention when taken in conjunction with the following description and the drawings, wherein.

DETAILED DESCRIPTION OF THE INVENTION

Figure 1:
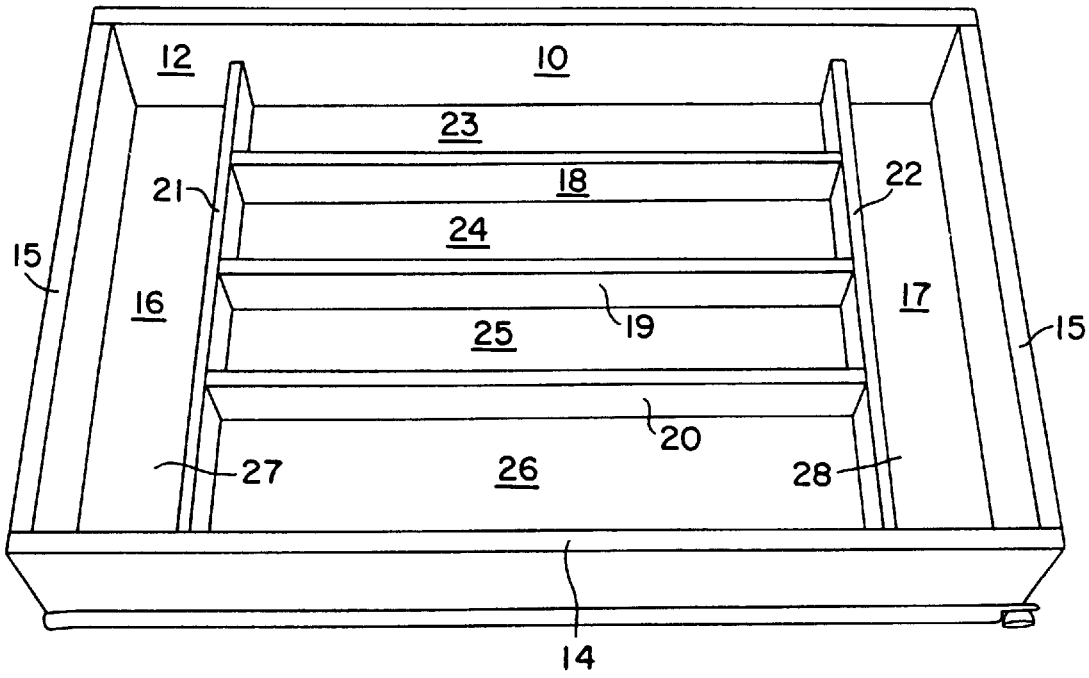
FIG. 1 is a perspective side view of the adjustable dividers as incorporated in a drawer in accordance with the invention.
Figure 2:
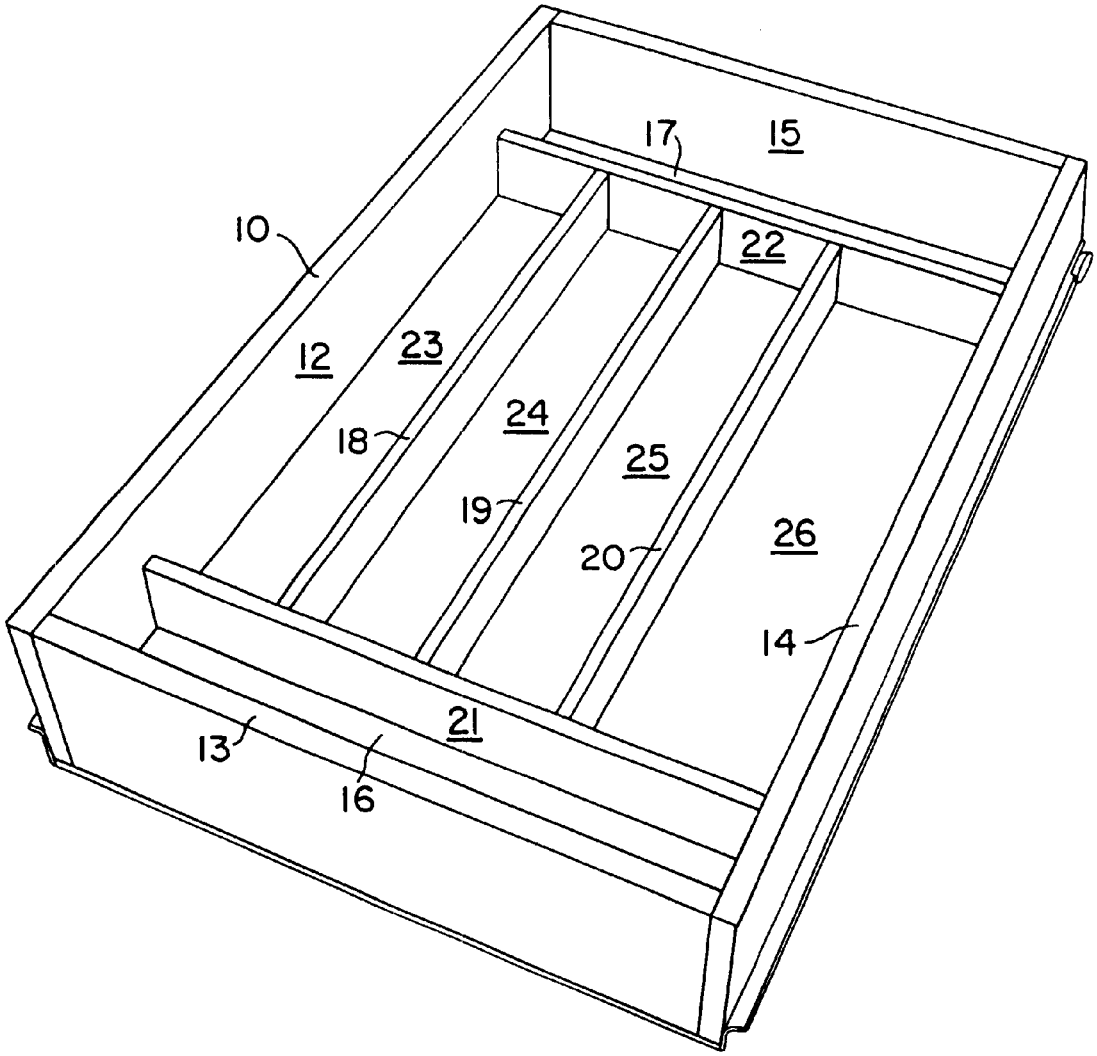
FIG. 2 is another perspective longitudinal view of the drawer and adjustable dividers shown in FIG. 1.

With respect to FIGS. 1 and 2, rectangular shaped drawer 10 includes side members 12, 13, 14 and 15 with bottom areas 16 and 17. Positioned within drawer 10 are adjustable divider members 18, 19 and 20 each of which extend between separator members 21 and 22 to form compartments 23, 24, 25 and 26. Other compartments 27 and 28 are respectively formed between side members 13 and separator 21 and end member 15 and separator 22. Adjustable dividers 18, 19 and 20 are of equal length and height. The length of adjustable dividers 18, 19 and 20 may be equally selected to adjust the size of compartments 16 and 17. As will become apparent from the following description, the width of compartments may be selectively varied by selecting the width of the leg of adjustable dividers 18, 19 and 20. The drawer and adjustable dividers may be made of any material normally used for drawer construction such as wood, plastic, metal and various composites.

Figure 3:
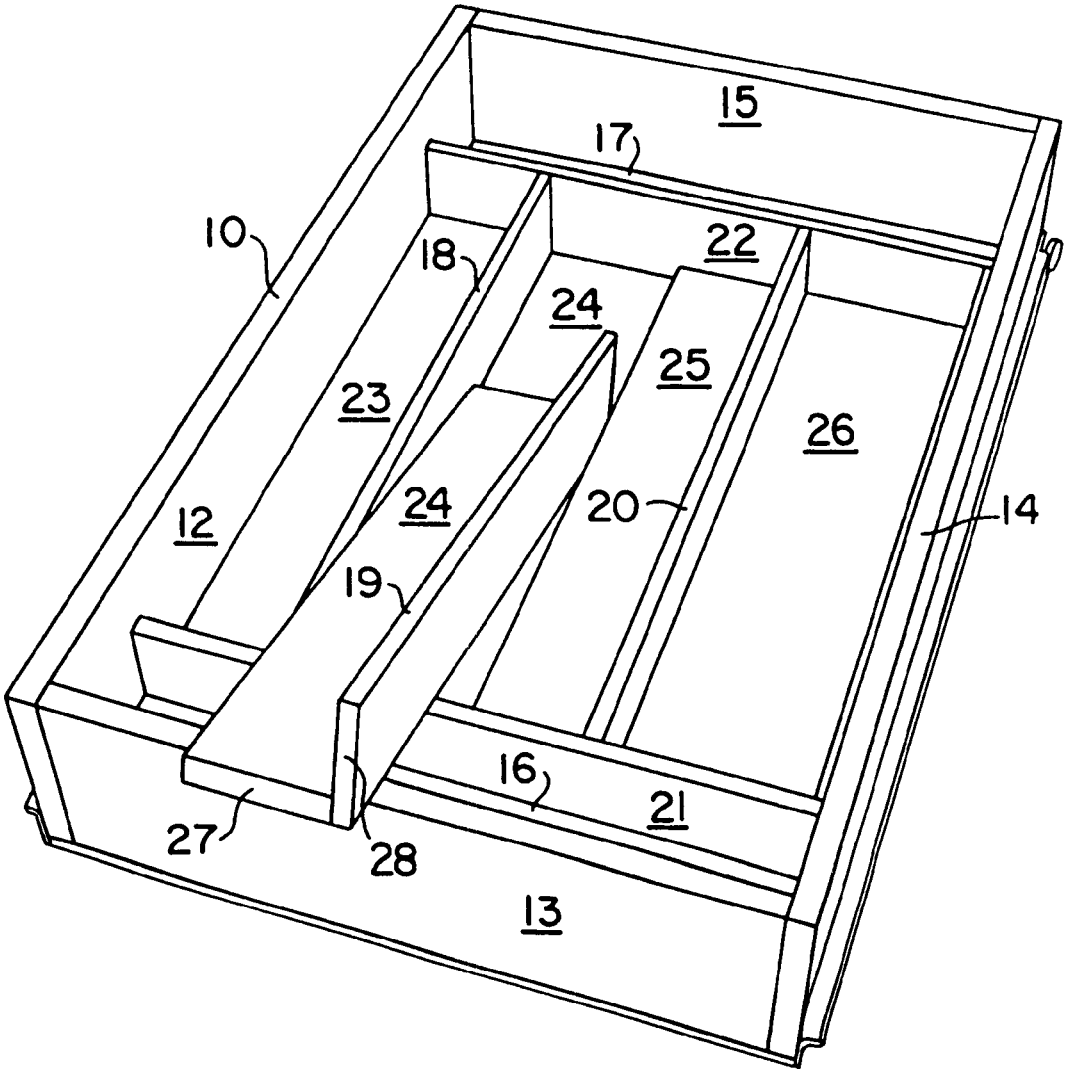
FIG. 3 is a perspective longitudinal view of the drawer of the present invention with one of the adjustable dividers shown removed from the drawer and laying on its side on top of the drawer.

With reference to FIG. 3, drawer 10 and its integral components are shown with L-shaped adjustable divider 19 shown removed from its location within the drawer and tilted on the end 13 of drawer 10 and illustrating legs 27 and 28. It is apparent that the width of legs 27 and 28 may be varied to respectively decrease the width of compartment 24 and the height of the compartment within drawer 10. Furthermore, the width of a compartment may be increased by placing an insert (not shown) beside the leg of the L-shaped adjustable divider member placed on the bottom of the drawer. It is understood that each of adjustable dividers may have equal or non-equal dimensions.

Figure 4:
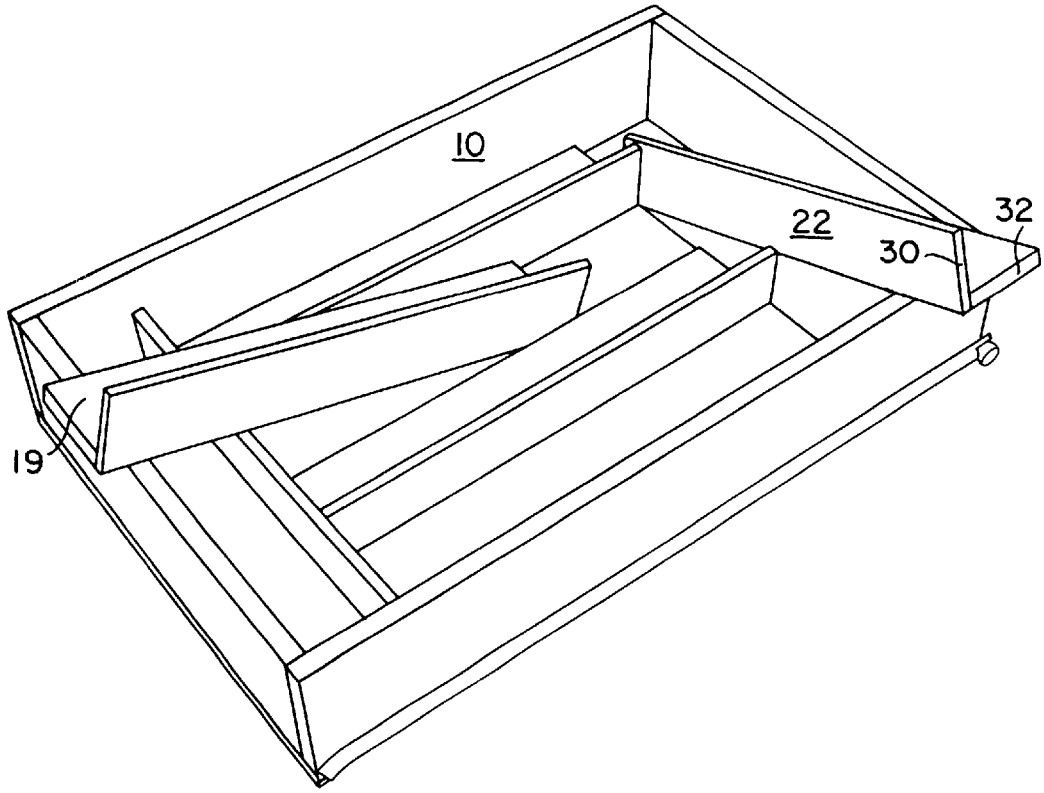
FIG. 4 is a perspective view of the drawer with several of the adjustable dividers removed and lying on top of the drawer to better illustrate their shape and construction.

FIG. 4 is a further perspective view of the drawer of the invention showing adjustable divider 19 tilted on top of drawer 10 and also showing separator member 22removed from its location and tilted on top of drawer 10. It is understood that L-shaped separator member 22 is similar to an adjustable divider member 18, 19 and 20 and that the width of each of legs 30 and 31 may be selected to adjust the height of compartment 17 and the width thereof.

Figure 5:
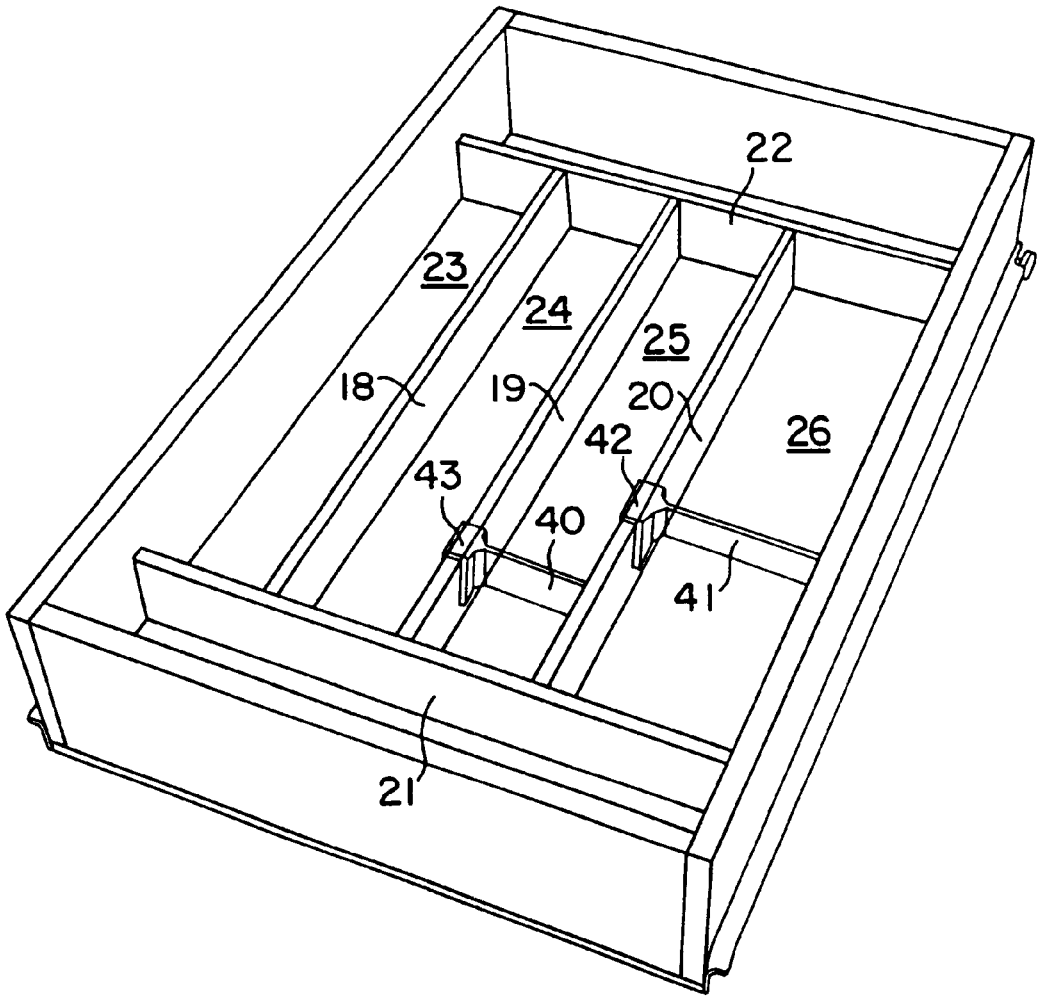
FIG. 5 is a modified perspective view of the drawer shown in FIG. 1 and showing the addition of transversely extending dividers clip mounted to various upstanding legs of the L-shaped dividers to form addition divided spaces in the drawer.

The modified embodiment of the invention shown in FIG. 5 illustrates the divided drawer shown in FIGS. 1 and 2 with the addition of transversely extending dividers 40 and 41 which respectively divide spaces 25 and 26 as shown in the Figure. Dividers 40 and 41 are respectively mounted to the upstanding legs 20 and 19 by clip-on mounting brackets 42 and 43. It is apparent that dividers such as dividers 40 and 41 may also be attached to any of the other upstanding legs of the L-shaped dividers as well as separator members 21 and 22.

Figure 6A:
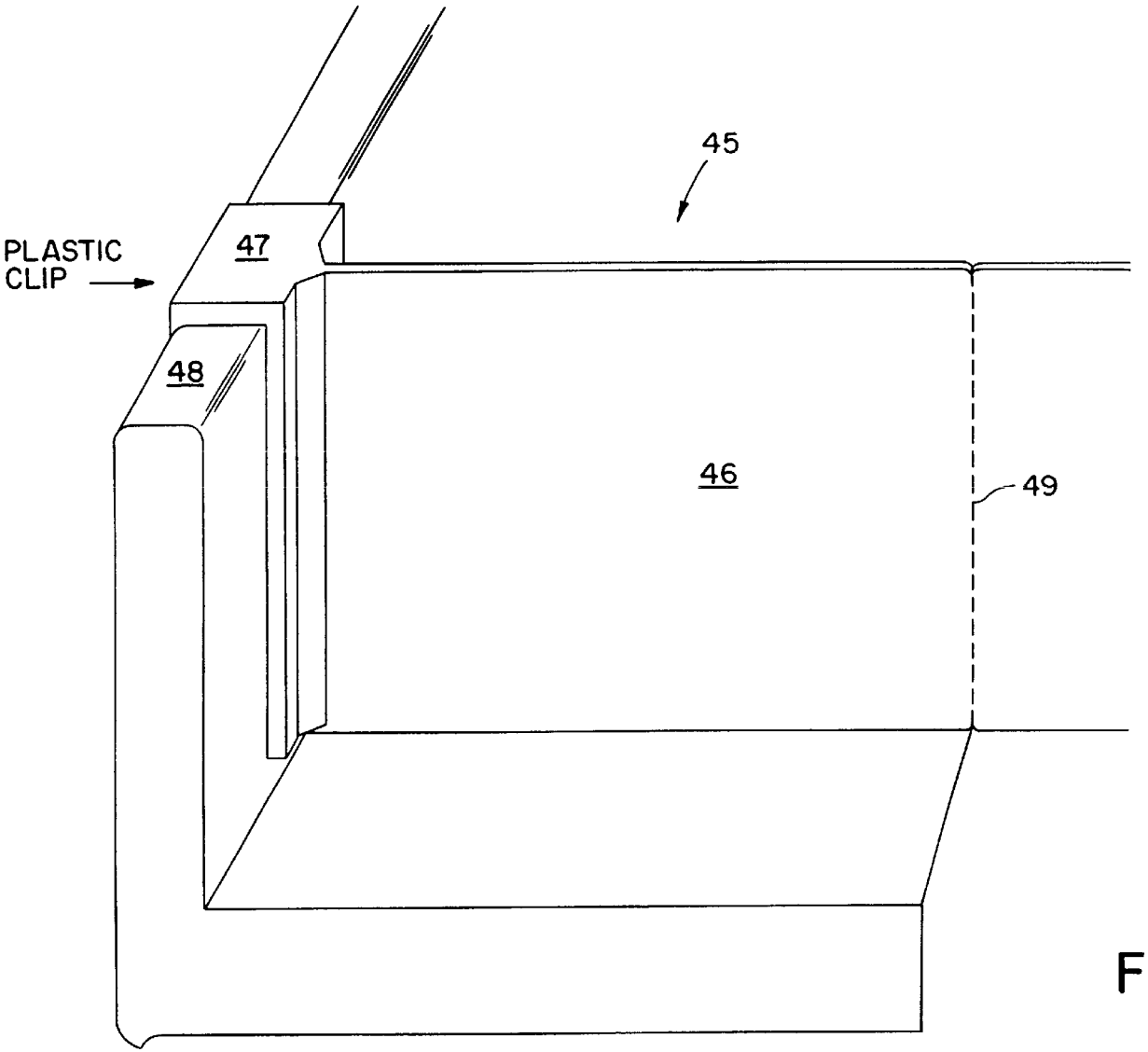
FIG. 6A is a detailed perspective view of the clip-on divider attached to the upstanding leg of an L-shaped divider.

FIG. 6A illustrates a preferred embodiment of a transversely extending divider 45which includes a main body portion 46 and a clip portion 47 for attachment to an upstanding leg portion 48 of an L-shaped divider. Clip portion 47 may be constructed of materials similar to that of the L-shaped divider members previously described. Main body portion 46 includes serrations such as that designated by the numeral 49 and which are provided to enable the main body portion to be more conveniently severed into widths to accommodate the desired divided space.

Figure 6B:
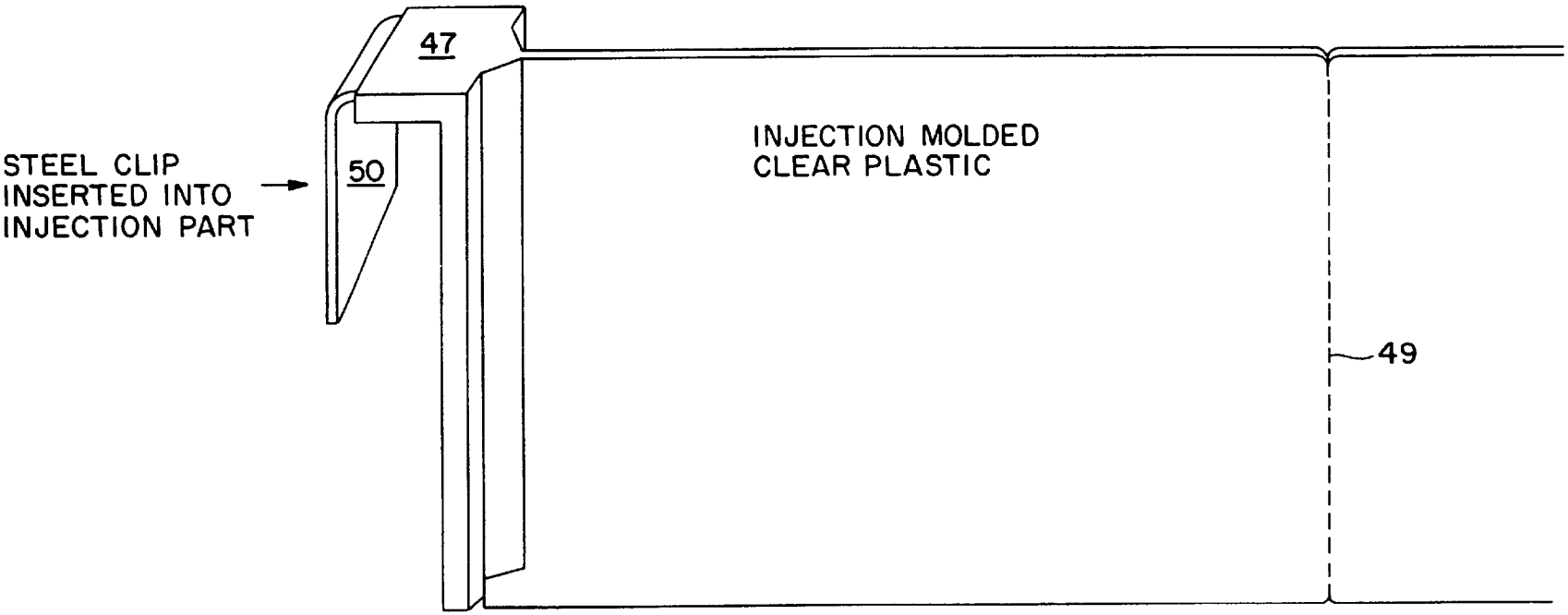
FIG. 6B is a detailed view of the clip-on divider it self.

Finally, FIG. 6B is a detailed view of the clip-on divider and its associated mounting structure. Clip portion 47 may preferably includes a steel insert 50 which is inserted into the clip portion 47 as shown. The space between clip portion 47 and insert 50 slips over the upstanding leg of the L-shaped diver members as previously disclosed.

It is readily apparent that the drawer and adjustable dividers of the invention enable unlimited variations in the size of the various compartments while utilizing drawer space more efficiently than other methods of forming compartments such as the common U-channel design, which has redundant verticals that are back-to-back and face-to-face when placed in the drawer. Moreover, the legs of each of the adjustable dividers may easily be trimmed to a selected width, thereby providing a selected variation in the width and height of each of the compartments formed by the L-shaped adjustable dividers. The only restriction is that each of the L-shaped adjustable dividers must preferably be of the same length to avoid compartments having slanted ends.

Therefore, it is desired that the present invention not be limited to the embodiments specifically described, but that it include any and all such modifications and variations that would be obvious to those skilled in this art. It is our intention that the scope of the present invention should be determined by any and all such equivalents of the various terms and structure as recited in the following annexed claims.

What is claimed is:

1. A drawer comprising respective opposing ends, side members, a bottom member, a number of L-shaped divider members each having a horizontally extending leg member, a vertically extending leg member with the horizontal and vertical extending leg members having an edge portion at the respective ends thereof and said L-shaped divider members along with the opposing ends and side member separating the drawer into two side compartments, at least one end compartment, and at least one interior compartment;

a side compartment, comprising:

an edge portion of a horizontally extending member of a first divider member abutting a respective side member of the drawer and a vertically extending leg member of the first divider member partially forming the side compartment together with the respective side member;

said at least one interior compartment, comprising:

an edge portion of a horizontally extending leg member and a vertically extending leg member of a second L-shaped divider member abutting a vertically extending leg member of an adjacent divider member to partially form said at least one interior compartments;

said at least one end compartment, comprising:

an edge portion of a horizontally extending leg member of a third L-shaped divider member respectively abutting a respective end member of the drawer and a vertically extending leg member abutting at least one end portion of the L-shaped divider members of said at least one interior compartment;

each one of the two side compartments being fully formed by a vertically extending leg member of a respective L-shaped divider member forming said at least one end compartment, and said at least one interior compartment being fully formed by respective end portions thereof being in abutting relationship with the respective vertically extending leg member forming said at least one end compartment; and the horizontally extending leg member of each of the L-shaped divider members resting on the bottom of the drawer.

2. A drawer according to claim 1, wherein the respective width and length of the leg members of the respective L-shaped divider members determines the respective width and length of the two side compartments, said at least one interior compartment and said at least one end compartment.

3. A drawer according to claim 1, wherein said opposing ends, side members, bottom member, and number of L-shaped divider members are made of materials selected from the group consisting of metal wood, wood composites or plastic.

4. A drawer according to claim 1, wherein said at least one interior compartment includes at least one transversely extending divider member and a clip-on mounting bracket for attachment to the vertically extending leg member of the second L-shaped divider member for dividing said at least one interior compartment into separate compartments.

5. A drawer according to claim 1, wherein at least one of said two side compartments includes at least one transversely extending divider member and a clip-on mounting bracket for attachment to the vertically extending leg member of the first L-shaped divider member for dividing said at least one of said two side interior compartments into separate compartments.

6. A drawer according to claim 4, wherein at least one of said two side compartments includes at least one transversely extending divider member and a clip-on mounting bracket for attachment to the vertically extending leg member of the first L-shaped divider member for dividing said at least one of said two side interior compartments into separate compartments.

7. A drawer according to claim 4, wherein said transversely extending divider member includes a body portion having serrated portions defining various width portions of the transversely extending divider member.

8. A drawer according to claim 4, wherein said clip-on mounting bracket includes a clip member extending from the bracket to form a U-shaped structure for retaining the end portion of an L-shaped divider member.

* * * * *